US005695077A

United States Patent [19]

Jay

[11] Patent Number: 5,695,077

[45] Date of Patent: Dec. 9, 1997

[54] REPLACEMENT TRACK FOR DISPLAY RACK

[75] Inventor: Richard Jay, Westport, Conn.

[73] Assignee: Display Technologies, Inc., Whitestone, N.Y.

[21] Appl. No.: 715,875

[22] Filed: Sep. 18, 1996

Related U.S. Application Data

[63] Continuation-in-part of Ser. No. 683,568, Jul. 15, 1996, Ser. No. 694,310, Aug. 8, 1996, Pat. No. 5,645,176, and Ser. No. 58,137, Aug. 8, 1996.

[51] Int. Cl.[6] ..... A47F 5/00

[52] U.S. Cl. ..... 211/59.2; 211/175; 211/183

[58] Field of Search ..... 211/59.2, 59.3, 211/183, 175; 312/42, 45, 60; 403/329

[56] References Cited

U.S. PATENT DOCUMENTS

| | | | |
|---|---|---|---|
| 1,758,098 | 5/1930 | Williams | 211/59.2 X |
| 2,996,344 | 8/1961 | Garman | 312/45 |
| 3,203,554 | 8/1965 | Pendergrast, Jr. et al. | 312/45 X |
| 3,477,774 | 11/1969 | Atwood | 312/45 |
| 4,436,269 | 3/1984 | Dirksing et al. | 403/329 X |
| 4,598,828 | 7/1986 | Young et al. | 312/42 X |
| 4,785,943 | 11/1988 | Deffner et al. | 211/59.2 |
| 4,785,945 | 11/1988 | Rowse et al. | 312/42 X |
| 4,801,025 | 1/1989 | Flum et al. | 211/59.2 X |
| 4,886,171 | 12/1989 | Spamer | 211/59.2 |
| 4,923,070 | 5/1990 | Jackle et al. | 211/59.2 |
| 4,955,486 | 9/1990 | Trulaske, Sr. | 211/59.2 |
| 4,958,739 | 9/1990 | Spamer | 211/592 X |
| 4,997,094 | 3/1991 | Spamer et al. | 211/59.2 X |
| 5,022,535 | 6/1991 | Spamer | 211/59.2 |
| 5,024,336 | 6/1991 | Spamer | 211/59.2 |
| 5,050,748 | 9/1991 | Taub | 312/42 X |
| 5,123,545 | 6/1992 | Hickman | 211/59.2 |
| 5,531,336 | 7/1996 | Parham et al. | 211/183 |
| 5,562,217 | 10/1996 | Salveson et al. | 211/59.3 |

*Primary Examiner*—Robert W. Gibson, Jr.
*Attorney, Agent, or Firm*—Amster, Rothstein & Ebenstein

[57] ABSTRACT

A replacement track is specially designed for a display rack channel devoid of any upstanding front lip. In one embodiment, the replacement track is provided with removable longitudinal segments in the front portion to allow a reduction in the longitudinal length of the track member to fit in a channel, and the back end of the replacement track is enlarged either in width or in height relative to a back end of the channel, so as to limit by abutment therewith the forward movement of the replacement track in the channel. In another embodiment, the replacement track is provided with removable longitudinal segments in the back portion to allow a reduction in the longitudinal length of the track member to fit in a channel and outwardly biased spring fingers extending along the longitudinal edges of the replacement track include locking means which engage cooperating locking means on the sidewalls of the channels to limit forward movement of the replacement track relative to the channel when the locking means interengage.

22 Claims, 8 Drawing Sheets

FIG. 11
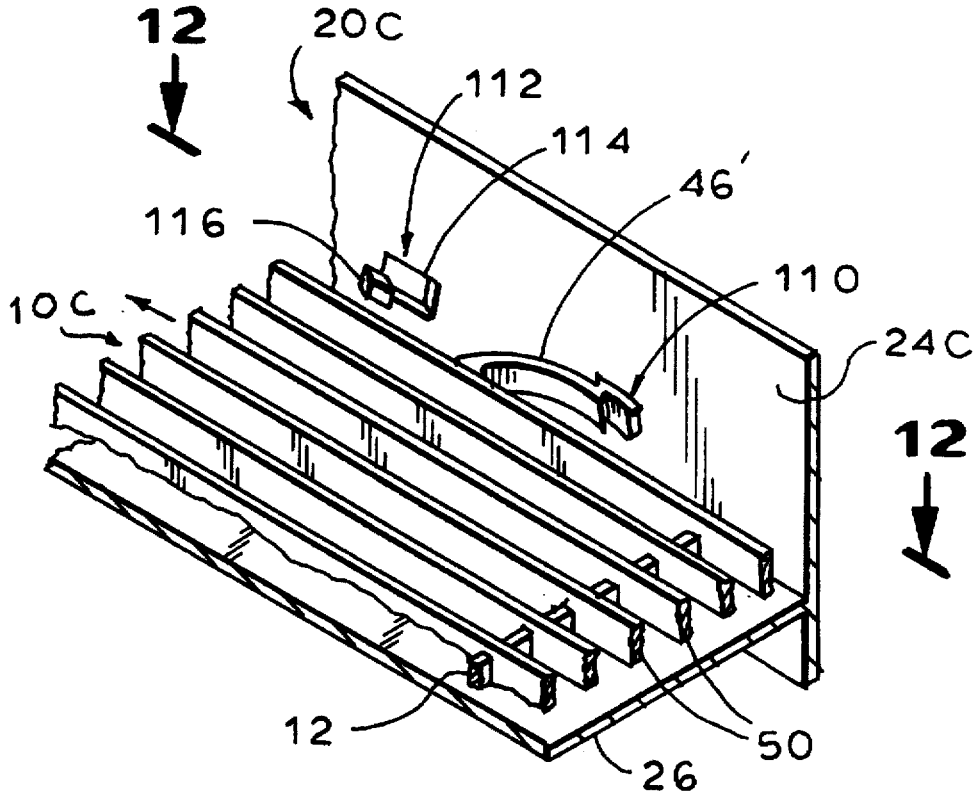
FIG. 12
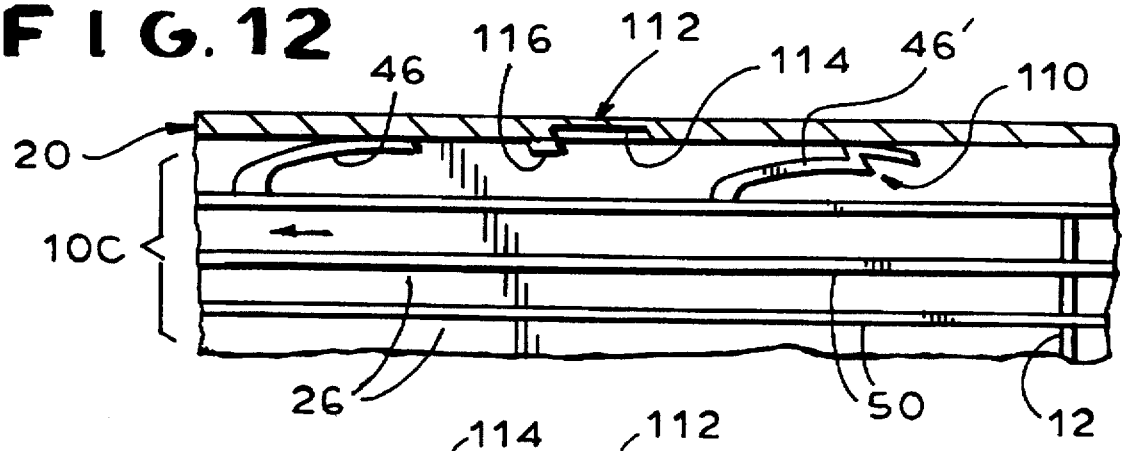
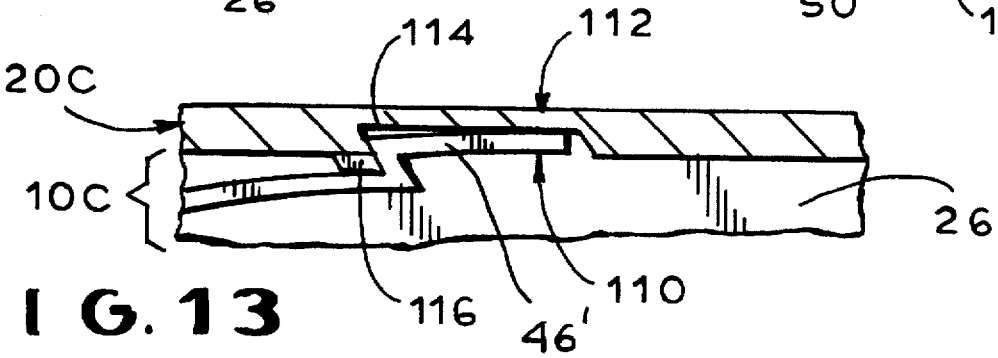
FIG. 13

REPLACEMENT TRACK FOR DISPLAY RACK

CROSS-REFERENCE TO RELATED APPLICATION

This is a continuation-in-part of U.S. patent application Ser. No. 08/683,568 filed Jul. 15, 1996 pending; Ser. No. 08/694,310, filed Aug. 8, 1996 now U.S. Pat. No. 5,645,176 and Ser. No. 29/058,137, filed Aug. 8, 1996 pending.

BACKGROUND OF THE INVENTION

The present invention relates to a track or floor for a display rack, and more particularly to a replacement track which is easily insertable.

With use, the floors or tracks of a display rack not only become worn away in parts by the bottles or other articles passing thereover, but also become clammy and sticky due to condensation, garbage, spillage and the like dropping thereon. While these signs of aging and use are undesirable in any display rack, they are especially undesirable in a gravity-fed display rack wherein the uneven wear or stickiness of a track could impede the easy movement of bottles or other articles down the channel.

If there are already bottles or other articles on a track to be replaced, these articles must first be removed from the track. Then a "replacement" track of whatever design is available is placed on the track to be replaced, centered relative to the side walls of the channel, and then glued or otherwise adhered to the track to be replaced so that the "replacement" track is held in place. Finally, as the last step, each of the articles removed from the channel must now be replaced in the channel atop the replacement track. Depending upon the number of articles that must be removed and replaced, it will appreciated that the substitution of a replacement track for an original track is a time consuming and bothersome process.

Further complicating the replacement procedure may be the need to trim the longitudinal length of the replacement track to meet the length of the channel. It is known to provide channels with breakaway or other removable end segments so that, even if a replacement track is designed for use with such a display rack, the longitudinal length of the channel on that display rack may have been altered by the user.

Still further complicating the replacement issue is the need of the user to maintain a good supply of the replacement tracks since, even after a replacement track has been installed, over time it may be necessary to remove the same and replace it with another replacement track. If one dispensed with the gluing or otherwise adhering of the "replacement" track to the original track, then the user would also need to maintain a supply of the replacement tracks in all of the different widths used for the original track. Clearly, the need exists for a "one size fits all" replacement track which could adjust to different width channels.

Accordingly, it is an object of the present invention to provide a replacement track for a display rack channel.

Another object is to provide such a replacement track which can be installed in the channel without initial removal of articles from the existing track and final placement thereof in the channel atop the replacement track.

A further object is to provide such a replacement track which, in a preferred embodiment, has means for centering and maintaining the same within the channel.

It is also an object of the present invention to provide such a replacement track which, in a preferred embodiment, enables a variable reduction in the longitudinal length thereof to enable it to fit within an existing channel.

It is another object to provide such a replacement track which, in a preferred "one size fits all" embodiment, can be used in a variety of channels of different widths.

It is a further object to provide such a replacement track which, in a preferred embodiment, after use of one side, can be turned over and used on the other side, thereby minimizing the need for separate replacement tracks.

It is a still further object to provide such a replacement track which, in a specially designed preferred embodiment, may be used with a display rack channel devoid of any front lip upstanding from the original track.

SUMMARY OF THE INVENTION

It has now been found that the above and related objects of the present invention are obtained in a replacement track for a display rack channel devoid of any upstanding front lip. The replacement track comprises a generally planar, at least slightly flexible, longitudinally elongate track member defining a front portion, a back portion and a body portion connecting the front and back portions. The front portion defines a wedge-shaped front for lifting articles supported by an existing track of a channel above the existing track and on to the front portion as the front portion is moved between the articles and the existing track. The front portion defines a plurality of removable longitudinal segments for enabling a reduction in the longitudinal length of the track member to fit in a channel, the front portion segments being successively removable for variably reducing the longitudinal length of the track member. The body portion defines a top surface, a bottom surface and a pair of longitudinal edges connecting the top and bottom surfaces, the body portion having biasing means on each longitudinal edge thereof for centering and maintaining the track member in a channel. The biasing means are outwardly biased spring fingers extending outwardly from the longitudinal edges of the body portion a variable distance so that the replacement track fits a variety of channels of different widths.

In a preferred embodiment, the front is generally convexly shaped. At least the body portion defines on both the top and bottom surfaces thereof slide means for reducing the friction generated by an article sliding thereover, whereby the track may be used in a regular or inverted orientation in the channel. Preferably the slide means are a plurality of parallel, longitudinally extending ridges. Optimally, the front and back portions of the track member also define the slide means on the top and bottom surfaces thereof.

The present invention also encompasses in combination a display rack and a replacement track, as described above, intermediate the sidewalls and supported by the track. The display rack comprises a channel having a transversely spaced pair of upstanding, longitudinally elongate sidewalls and a transversely extending, longitudinally elongate track joining the track sidewalls. The channel has a back end and is devoid of any upstanding front lip. At least the body portion defines on both the top and bottom surfaces thereof slide means for reducing the friction generated by an article sliding thereover, whereby the track may be used in a regular or inverted orientation in the channel.

In one preferred embodiment, the track member has a back end enlarged in width relative to a back end of the channel to limit by abutment therewith the forward movement of the replacement track in the channel. Preferably the track back end abuts both sides of the channel back end.

In another preferred embodiment, the back portion of the track member has a back end enlarged in height relative to a back end of the channel to limit by abutment therewith the forward movement of the replacement track in the channel. Preferably the track back end defines a depending lug and, optimally, also an upstanding lug for use as the "depending" lug when the track replacement is used in an inverted orientation.

The present invention further encompasses a replacement track for a display rack channel devoid of an upstanding front lip. The replacement track comprises a generally planar, at least slightly flexible, longitudinally elongate track member defining a front portion, a back portion and a body portion connecting the front and back portions. The front portion defines a wedge-shaped front for lifting articles supported by an existing track of a channel above the existing track and onto the front portion as the front portion is moved between the articles and the existing track. The back portion defines a plurality of removable longitudinal segments for enabling a reduction in the longitudinal length of the track member to fit in a channel, the back portion segments being successively removable for variably reducing the longitudinal length of the track member. The body portion defines a top surface, a bottom surface and a pair of longitudinal edges connecting the top and bottom surfaces. The body portion has biasing means on each longitudinal edge thereof for centering and maintaining the track member in a channel. The biasing means includes a plurality of longitudinally spaced pairs of outwardly biased spring finger extending outwardly from the longitudinal edges of the body portion a variable distance so that the replacement track fits a variety of channels of different widths. One and only one of the pairs of spring fingers includes outwardly projecting engaging means for engaging with a cooperating inwardly projecting engaging means of the channel sidewalls to limit the forward movement of the replacement track relative to the channel when the engaging means interengage.

The present invention still further encompasses a display rack defining a channel devoid of an upstanding front lip and a replacement track, as described above, intermediate the channel sidewalls and supported by the track. The channel has an inwardly projecting engaging means on each of the sidewalls for cooperating with the outwardly projecting engaging means of the spring fingers to limit the forward movement of said replacement track in the channel.

BRIEF DESCRIPTION OF THE DRAWING

The above and related objects, features, and advantages of the present invention will be more fully understood by reference to the following detailed description of the presently preferred, albeit illustrative, embodiments thereof when taken in conjunction with the accompanying drawing wherein:

FIG. 11 is a fragmentary isometric view of a third "specially designed" embodiment of the present invention, showing a portion of the replacement track in a display rack;

FIG. 12 is a top plan view thereof, taken along the line 12—12 of FIG. 11; and

FIG. 13 is an enlarged close-up of a portion of FIG. 12.

DETAILED DESCRIPTION OF THE PREFERRED EMBODIMENTS

Figure 1:
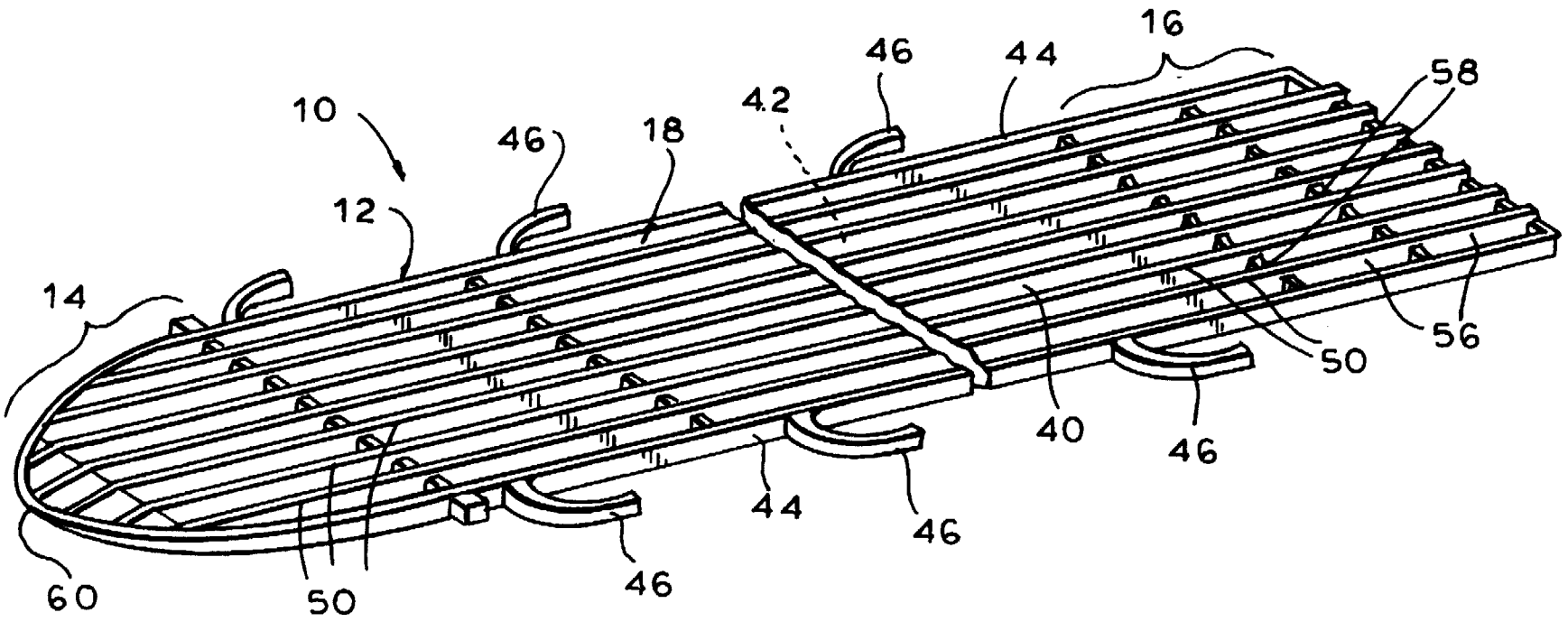
FIG. 1 is a fragmentary isometric view of a replacement track.

Referring now to the drawing, and in particular to FIG. 1 thereof, therein illustrated is a replacement track according to the present invention, generally designated by the reference numeral 10. The replacement track 10 comprises a generally planar, longitudinally elongate track member generally designated 12 and configured and dimensioned to be positioned on top of an existing display rack channel having a front lip 28 projecting upwardly from the track member 12. More particularly, the track member 12 defines a front portion generally designated 14, a back portion generally designated 16, and a body portion generally designated 18 and connecting the front and back portions 14, 16. For reasons which will become apparent hereinafter, the track member 12 is preferably at least slightly flexible along its longitudinal length so that the front portion 14 and the back portion 16 thereof may be bent upwardly slightly (and preferably resiliently) relative to the body portion 18.

Figure 2:
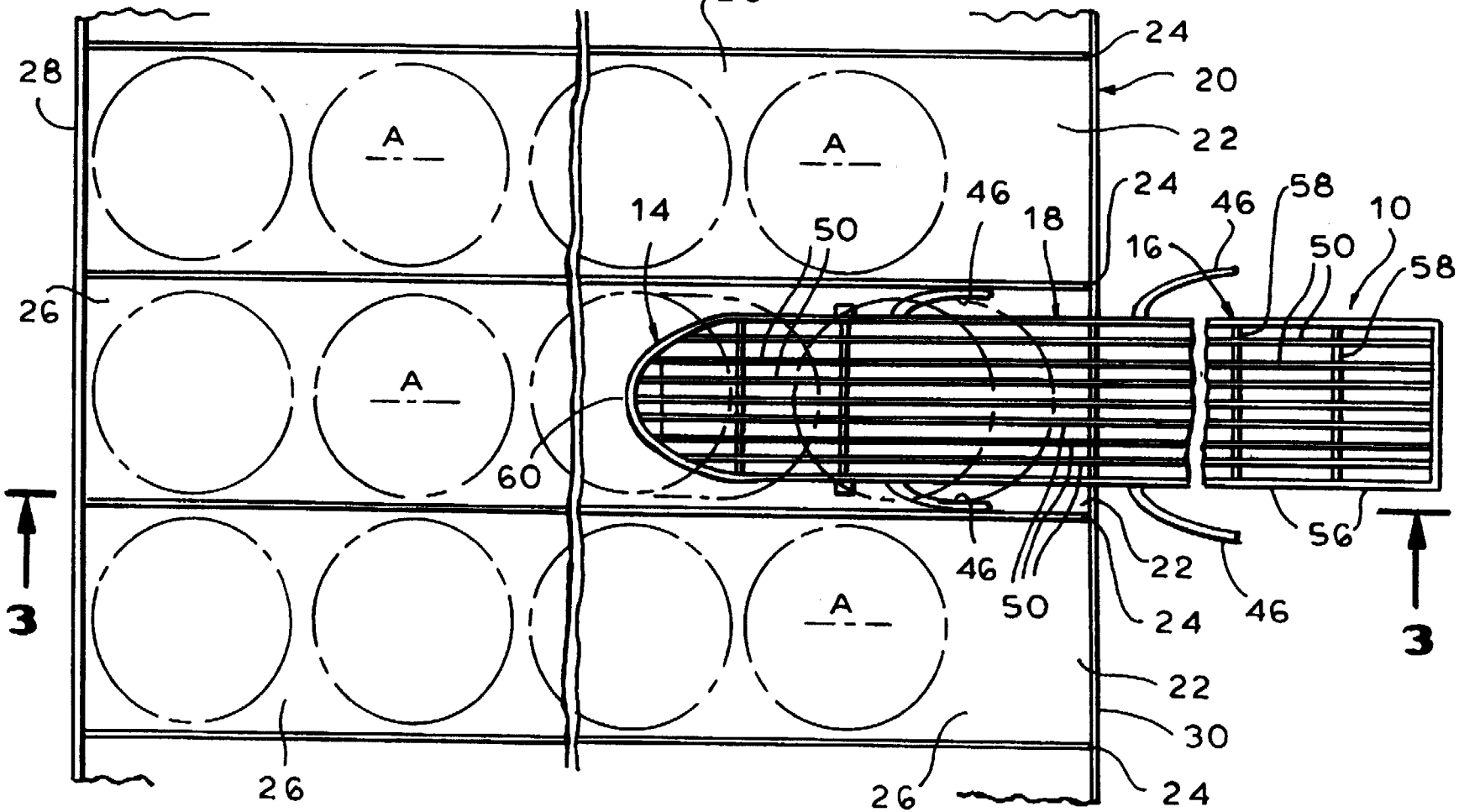
FIG. 2 is a fragmentary top plan view of a replacement track in the process of being inserted into a channel of a display rack, bottles in the several channels being indicated in phantom line.

Referring now to FIG. 2, the replacement track 10 is intended for use with a display rack, generally designated 20. Typically the display rack 20 defines a plurality of display rack channels 22 in parallel side-to-side disposition, with each channel 22 being defined by a pair of upstanding sidewalls or partition members 24, and an existing track or floor 26 extending between and connecting the sidewalls 24. At the front of each channel 22, an upstanding front lip 28 limits movements of bottles or like articles A down the channel 22, thereby to keep the bottoms of the articles on the track 26. At the back of each channel 22 an upstanding back wall or lip 30 is provided.

In a gravity-fed display rack typically the back wall or lip 30 serves little function beyond defining the back end of the channel 22. The channels 22 of the display rack 20 are typically filled with articles from the rear, with the articles being introduced into the channel by the retailer moving the same over the bottom wall or lip 30 and into the channel 22 proper so that they rest on the track 26 and slide forwardly under the influence of gravity. The back wall or lip 30 is merely a point of reference indicating to the retailer when the capacity of the channel has been reached. To some degree in a flat display rack, the back wall or lip 30 may also help to support in an upright orientation the last of the articles in the channel. (In a gravity-fed display rack, the back wall or lip 30 does not even perform this function as gravity automatically does so.) Accordingly, the top of the back wall or lip 30 is typically relatively low, much lower than the top of the front wall 28 of the channel.

At least the body portion 18 defines a top surface 40, a bottom surface 42, and a pair of longitudinal edges 44 connecting the top and bottom surfaces 40, 42. The body portion 18 has biasing means 46 on at least one longitudinal edge 44 thereof for maintaining the track member 12 in a channel 22 by engagement with the sidewalls 24 thereof. The biasing means 46 enables the replacement track 10 to be of "one size fits all" design in that the variable maximum extension of the bias means 46 from the longitudinal edge 44 of the track member 12 enables the biasing means 46 to engage one sidewall 24 of the channel while the opposite longitudinal edge 44 of the track member engages the other sidewall 24 thereof. As illustrated, there are three biasing means 46 longitudinally spaced along each of the longitudinal edges 44. The disposition of the biasing means 46 on both longitudinal edges 44 provides automatic centering of the track member 12 in the channel 22. The biasing means 46 are illustrated as resilient spring fingers 46, the spring fingers 46 extending outwardly and rearwardly to facilitate insertion of the replacement track 10 in the channel 22 from the rear or back thereof. The front wall or lip 28 of the channel 22 limits the forward movement of the track member 12 in the channel 22, the downwardly sliding articles A assisting in maintaining the front of track member 12 adjacent the front of channel 22 during use thereof.

While no biasing means 46 are illustrated on the front or back portions 14, 16, they may also be provided there, if desired.

At least the body portion 18 defines on both the top and bottom surfaces 40, 42 thereof slide means 50 for reducing the friction generated by an article sliding thereover. The friction-reducing slide means 50 is preferably a plurality of parallel, longitudinally extending ridges upstanding from the track member 12. Preferably the slide means 50 are provided on both the top and bottom surfaces of at least body portion 18 so that, after replacement track 10 has been in use for a period of time and the top surface 40 thereof now requires replacement, one has only to remove the replacement track 10 from the channel, turn it over, and replace it in the channel to provide a fresh, clean top surface (previously the bottom surface 42) over which the articles may travel within the channel 22. The ability to use each replacement track 10 twice minimizes the number of replacement tracks which must be manufactured, purchased, shipped and stored, thereby cutting expenses in various areas for all concerned. Where present on all three portions 14, 16 and 18, the ridges 50 of the front portion 14, rear portion 16 and body portion 18 are preferably in longitudinal alignment.

Typically it is not possible to remove the replacement track 10 from the channel 22 without first removing the articles therefrom and later replacing the articles on the new top surface of the inverted replacement track 10. In order to avoid the extra effort involved in such a "turnover" of the replacement track 10, however, the biasing means 46 may be especially designed so that they do not catch on the sidewalls 24 when the track member 12 is pulled rearwardly out of the channel 22. Thus, the articles resting on the replacement track 12 simply fall back onto the original track 26. At this point, the inverted replacement track member 12 may be reinserted between the original track 26 and the articles A resting thereon.

The back portion 16 defines a plurality of removable longitudinal segments 56 for enabling a reduction in the longitudinal length of the track member 12 so as to enable it to fit in a channel 22. As illustrated, the back portion segments 56 are breakaway segments. At the front of each of the back portion segments 56 is a line of weakness 58 which enables the adjacent back portion segment 56 to be easily and cleanly broken off, much as breakaway back portions are provided on certain display racks. The back portion segments 56 are successively removable so as to enable reducing the longitudinal length of the track member segment by segment until it fits into the channel. Preferably the back portion segments 56 include slide means 50 to facilitate movement of the articles thereover.

The front portion 14 defines a wedge shaped front 60 for lifting articles supported by an existing track of a channel 22 above the existing track and on to the front portion 14 as the front portion 14 is moved between the articles and the existing track. The wedge shape is defined by a forwardly and upwardly bevelled bottom surface and a forwardly and downwardly bevelled top surface. The front 60 is also generally convexly shaped to conform to the generally convexly curved front commonly found on the original tracks of display rack channels. The term "generally convexly curved" as used herein encompasses a chevron shape or arrowhead shape as well as a smoothly convex curve. The convex curvature reduces the effort required to initially lift articles off an existing track of a channel, above the existing track and on to the front portion 14 as the front portion 14 is moved between the articles and the existing track. The combination of the chisel-shape and convex curvature of the front 60 facilitates the insinuation of the front portion 14 between the articles and the existing track. Preferably the front portion 14 includes slide means 50 to facilitate movement of the articles thereover.

Figure 3:
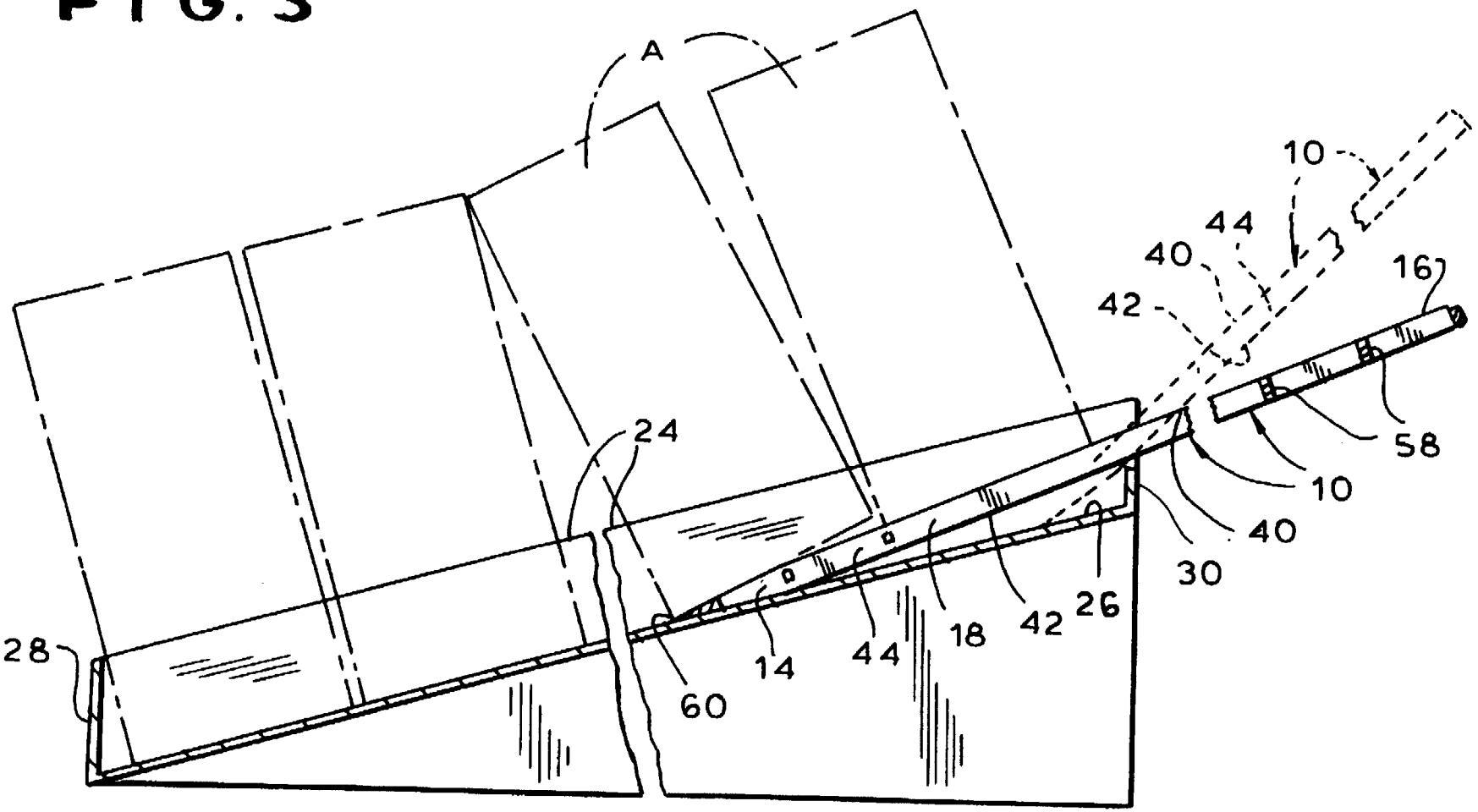
FIG. 3 is a sectional view taken along the line 3—3 of FIG. 2, with the initial position of the replacement track being illustrated in phantom line.
Figure 4:
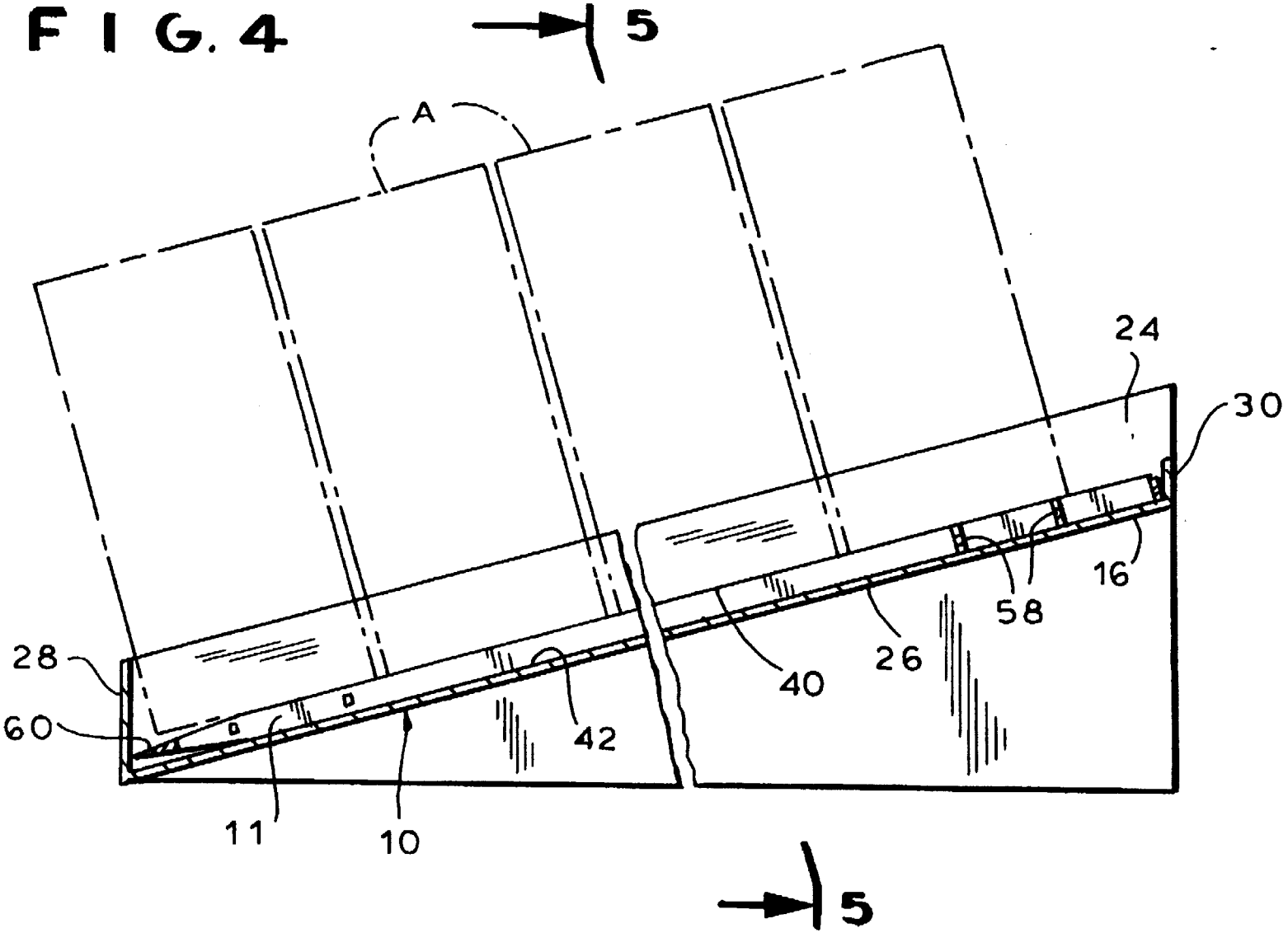
FIG. 4 is a fragmentary side elevation view of the channel with the replacement track in place.
Figure 5:
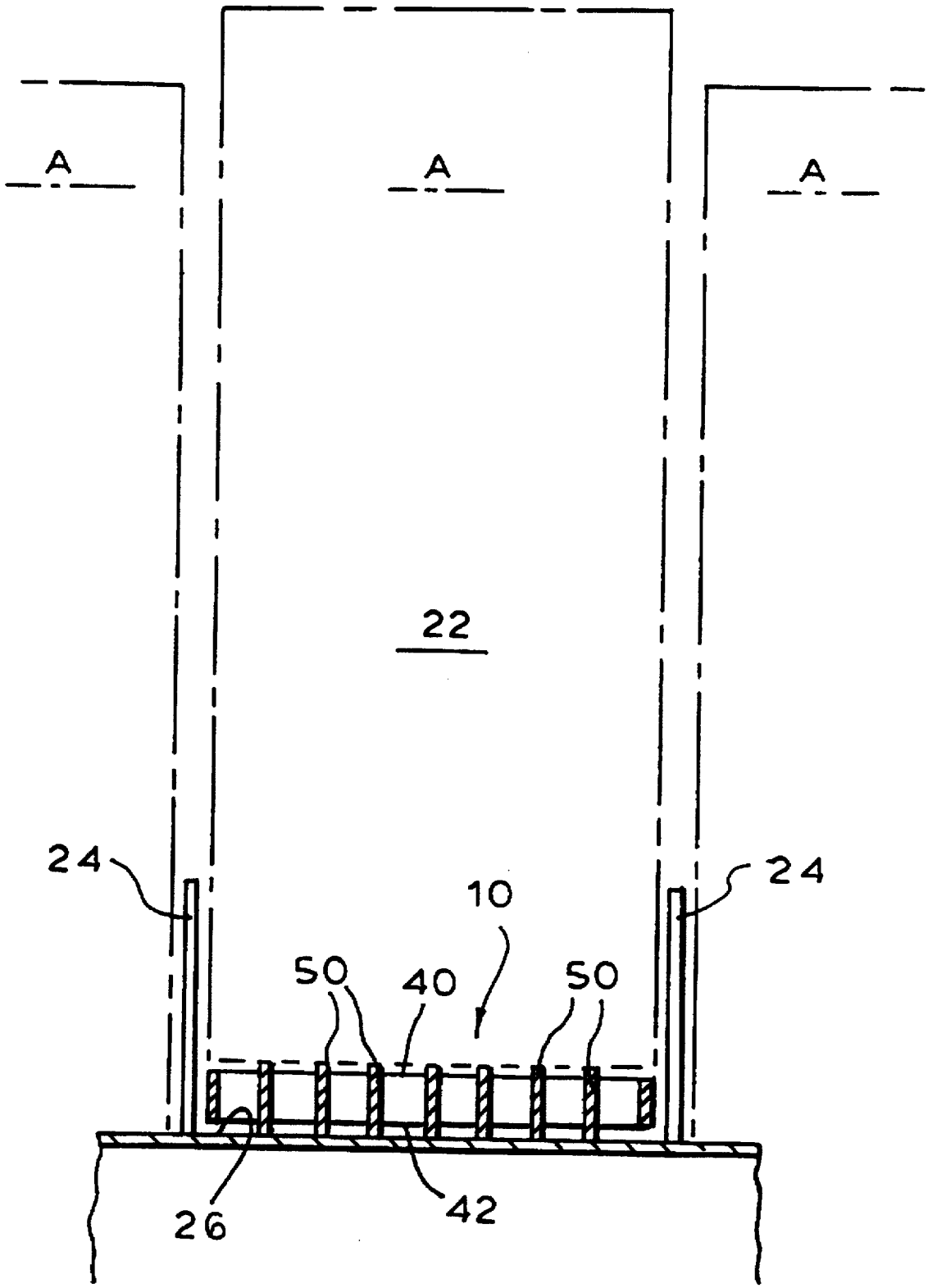
FIG. 5 is a sectional view taken along the line 5—5 of FIG. 4.
Figure 6:
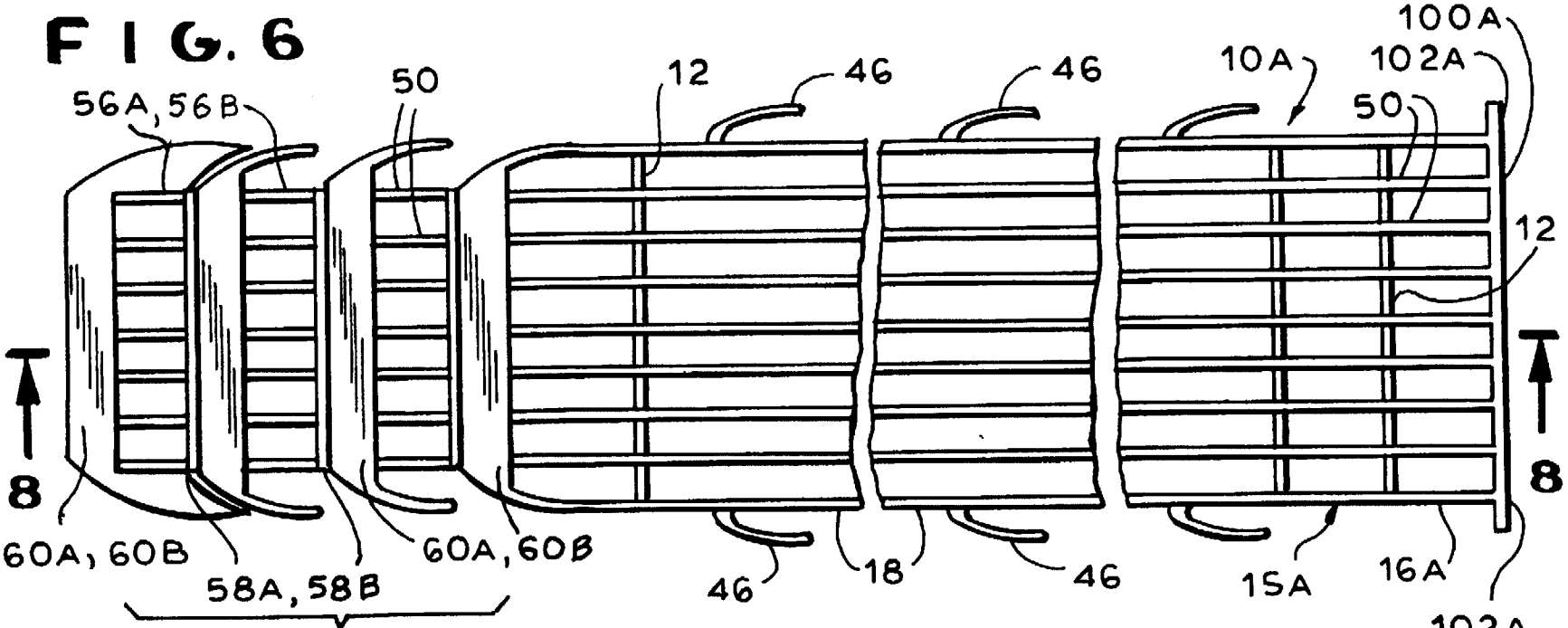
FIG. 6 is a fragmentary top plan view of a first "specially designed" embodiment of the present invention.
Figure 8:
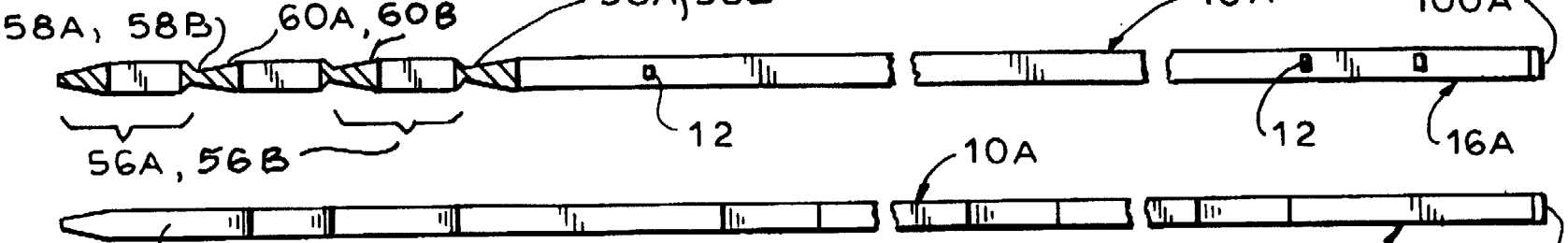
FIG. 8 is a fragmentary sectional view thereof, taken along the line 8—8 of FIG. 6.
Figure 7:
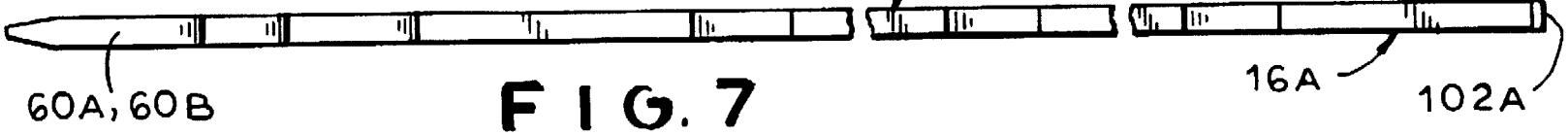
FIG. 7 is a fragmentary side elevational view thereof.
Figure 9:
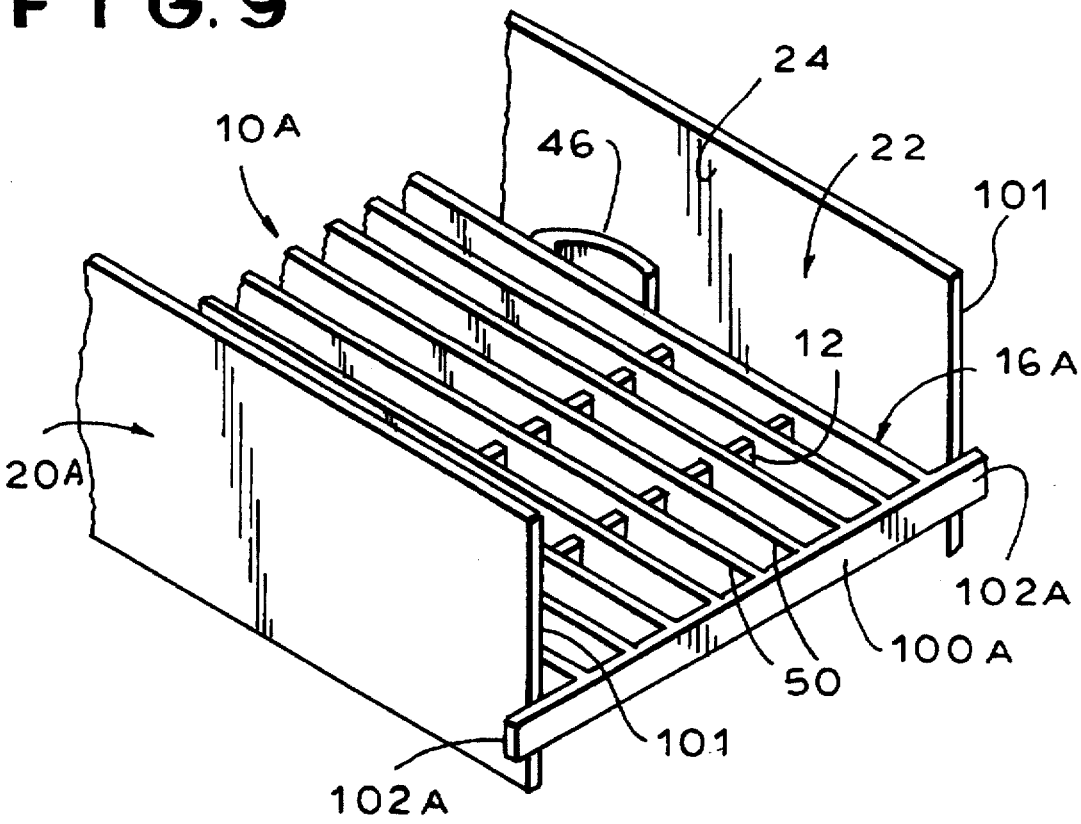
FIG. 9 is a fragmentary isometric view showing the back portion thereof in a display rack.

Referring now to FIGS. 2 and 3, to insert the replacement track 10 in an existing channel, the front portion 14 of the replacement track 10 is placed over (and usually on) the back wall or lip 30 of the channel 22 and slid forwardly and downwardly against the existing track 26, especially where the articles A meet the existing track 26. The front portion 14 is oriented so that the bottom surface of the front 60 is flat against the existing track 26, optionally with the slide means 50 of the replacement track 10 slightly offset from those of the existing track 26 to enable a closer fit. Then the replacement track 10 is forcibly moved forwardly so that the upper surface of the front 60 lifts the articles successively, allowing them to move rearwardly over the front portion 14 as the front 16 moves between the next article A and the existing track 26. The limited flexibility of the track member 12 facilitates positioning of the replacement track 10 over the back wall or lip 30 and at the intersection of the articles A and the existing track 26, with the replacement track 10 being at an appropriate angle for further forward and lifting motion when it is moved forwardly by the user until it reaches the fully inserted position illustrated in FIGS. 4 and 5.

If the channel 22 is almost entirely filled with articles, it may be necessary to remove one or two of the articles from the rear thereof so as to enable the front 60 of the replacement track 10 to assume a desirable orientation for insinuating or interposing itself between the articles A and the existing track 26.

To summarize, the present invention provides a replacement track for a display track channel having an upstanding front lip, the replacement track being installable in the channel without initial removal of articles from the existing track and final placement thereof in the channel atop the replacement track. The replacement track, in a preferred embodiment, includes means for centering and maintaining the same within a variety of existing channels, means enabling a variable reduction in the width thereof so as to enable it to fit within a variety of existing channels, means enabling a variable reduction in the longitudinal length thereof so as to enable it to fit within an existing channel, and slide means on both sides so that, after use on one side, it can be turned over and used on the other side to minimize the need for separate replacement tracks.

The present invention goes even further, however, and also provides a replacement track which is "specially designed" for a display track channel devoid of any upstanding front lip. As will be appreciated by those skilled in the display rack art, various forces play on a replacement track tending to force the replacement track forwardly within the channel. For example, in a gravity-fed display rack any friction between the articles A and the replacement track 10 will tend to force the replacement track 10 forwardly, relative to the display rack 20, as the articles travel down the channel 22 from the back thereof to the front thereof. In the preferred embodiments discussed hereinabove, the forward movement of the replacement track 10 is limited by the abutment thereof with the front lip 28. In other words, the front lip 28 acts as a stop for the replacement track 10 even if it does not act as a stop for the articles 10 traveling down the channel 22.

The remainder of the specification is directed to three embodiments of a replacement track which are "specially designed" for use with a display rack which does not have any upstanding front lip 28, like elements of the specially designed replacement track embodiments, generally designated 10A, 10B and 10C, which are similar in structure or function to parts of the original replacement track 10 will be identified herein by like reference numerals.

Referring now to FIGS. 6–13, the display racks 20A, 20B and 20C are functionally similar to the display rack 20 previously described hereinabove except for the absence of any front lip 28 extending upwardly from the original rack or floor 26 intermediate the channel sidewalls 24 and as noted below.

Both the first replacement track 10A illustrated in FIGS. 6–9 and the second replacement track 10B illustrated in FIG. 10 differ from the replacement track 10 described hereinabove in that the back portions 16A, 16B do not define a plurality of removable back portion longitudinal segments 56 for enabling a reduction of the longitudinal length of the track member 12 so as to enable it to fit within a given channel 22. Instead, the front portion 14A, 14B defines a plurality of removable front portion longitudinal segments 56A, 56B for enabling a reduction in the longitudinal length of the track member so as to enable it to fit in a given channel 22. As illustrated, the removable front portion longitudinal segments 56A, 56B are breakaway segments. At the back of each of the front portion longitudinal segments 56A, 56B is a line of weakness 58A, 58B, which enables the adjacent front portion segments 56A, 56B to be easily and cleanly broken off the body portion 18, much as breakaway back portions are provided on certain display racks. The front portion longitudinal segments 56A, 56B are successively removable so as to enable reducing the longitudinal length of the replacement track member 10A, 10B segment by segment, until it fits into the channel 22. Preferably the front portion longitudinal segments 56A, 56B includes slide means 50 to facilitate movement to the articles A thereover. The front portion longitudinal segments 56A, 56B are similar to the front portion 14 described hereinabove in that they each exhibit a wedge-shaped front 60A, 60B (similar to front 60 of original track 10) which is preferably also generally convexly shaped curved.

Referring now to FIGS. 6–9 in particular, the first "specially designed" replacement track 10A has a back portion 16A having a back end 100A enlarged in width relative to a back end 101 of the channel 22. Preferably the track back end 100A has at least one laterally extending wing 102A extending at least up to the outer surface of one channel sidewall 24, and preferably two oppositely extending wings 102A extending laterally to both channel sidewalls 24 (as illustrated). Thus the enlarged track back end 100A limits by abutment with the channel back end 101 the forward movement of the replacement track 10A in the channel 22. Preferably, as illustrated, the track back end 100A abuts both lateral sidewalls 24 of the channel back end 101, for the same purpose.

Figure 10:
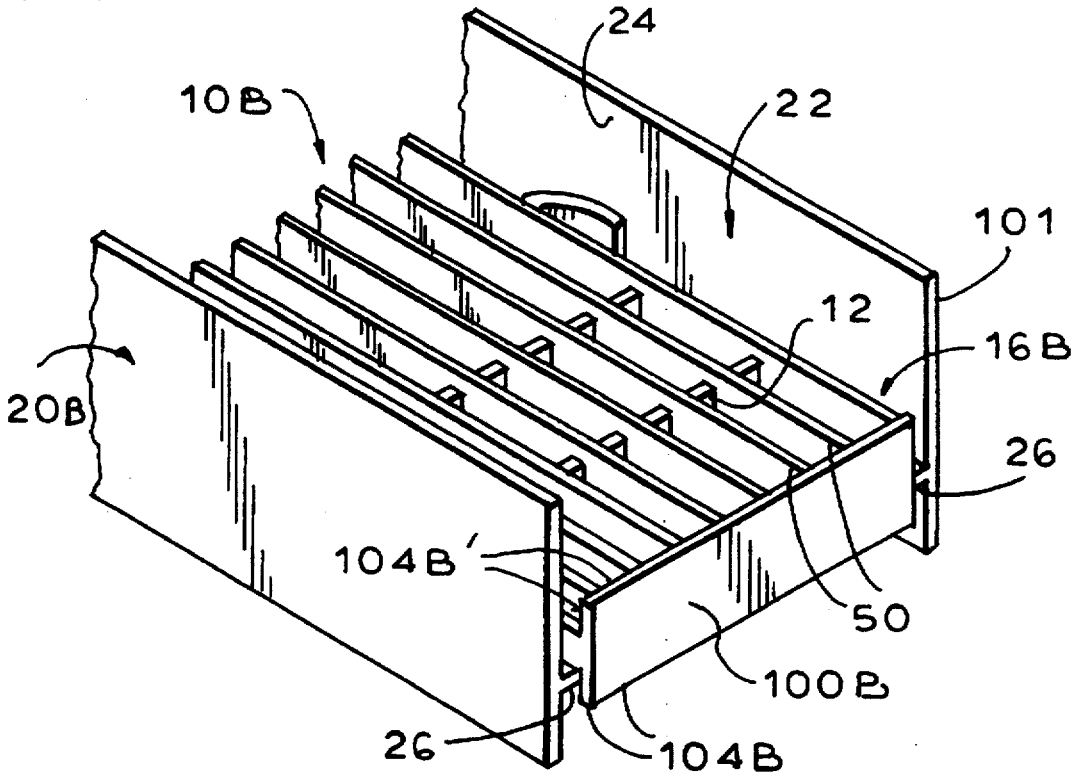
FIG. 10 is a fragmentary isometric view of a second "specially designed" embodiment, showing the back portion of the replacement track in a display rack.

Referring now to FIG. 10 in particular, the second "specially designed" replacement track 10B has a back portion 16B having a back end 100B enlarged in height relative to a back end 101 of the channel 22. Preferably the replacement track back end 100B defines a depending lug 104B which projects downwardly from the track member 12 of the replacement track a distance sufficient to abut in an interference fit with the back end 101 of channel 22, that is, the original track floor 26. Thus the forward movement of the replacement track 10B in the channel 22 is limited by the abutment of the track back end 100B and the channel back end 101, and in particular the back end of the original track. Optimally, the replacement track back end 100B also defines an upstanding lug 104B' which projects upwardly from the track 12 of the replacement track 10B a distance sufficient to abut in an interference fit with the back end 101 of channel 22 (that is, the original track floor 26) when the replacement track is used in an inverted orientation so that the upwardly projecting lug 104B' becomes the depending lug 104B as described above. The purpose of the two oppositely extending lugs 104B, 104B' is to enable the replacement track 10 to be used in either a regular or inverted orientation.

It will be appreciated by those skilled in the art that a given replacement track may employ both the laterally extending wings 102A and the vertically projecting lugs 104B for extra security.

It would be appreciated that the replacement tracks 10A and 10B are substantially different from the basic replacement track 10 and require a specially designed mold due to the different locations of the breakaway longitudinal segments thereon. On the other hand, the replacement tracks 10A and 10B do not require special display racks 20 and, thus, can be used as "replacement" tracks both for conventional display racks which have an upstanding front lip as well as the newer display racks which lack an upwardly projecting front lip.

Unlike the first and second "specially designed" replacement tracks 10A and 10B, the third "specially designed" replacement track 10C is similar to the original replacement track 10 described hereinabove in that it uses removable back portion longitudinal segments in order to obtain the track length adjustability which enables it to be used in connection with channels 22 of different lengths. Indeed, referring now to FIGS. 11 and 12 in particular, the only modification to the replacement track 10 is the provision of locking means 110 on the outer surface of one, and only one, pair 46' of a longitudinally spaced plurality of pairs of spring fingers 46 (one spring finger 46 of each pair being on each respective longitudinal edge of the replacement track 10C). If locking means 110 are provided on additional pairs of spring fingers, the additional locking means are nonfunctional.

On the other hand, unlike the first and second "specially designed" replacement tracks 10A and 10B, the third track 10C must be used in conjunction with a specially modified display rack 20C which has a special engaging or locking means, generally designated 112, in each of the sidewalls 24C thereof. More particularly, the locking means 112 of each sidewall 24C of track 10C includes a recess in or aperture 114 through the sidewall 24C and a cam 116 projecting slightly into the channel 22 from the sidewall 24C such that it guides the engaging or locking means, generally designated 110, of a spring finger 46' of a forwardly moving replacement track 10C into the recess or aperture 114 (illustrated as a recess in FIGS. 11 and 12). The locking means 112 is arranged along the longitudinal length of the sidewall 24C such that, when the locking elements 110 and 112 interlock or interengage, the front of the replacement track 10C is properly disposed relative to the front of the channel 22. It will be appreciated that a variety of conventional locking means 110 on the spring fingers 46' and cooperating locking elements 112 on the channel sidewall 24C may be employed so long as the interaction therebetween acts to limit forward movement of the replacement track 10C within the channel 22C.

The replacement track 10C may be removed from the channel 22C by manually moving the same rearwardly until the locking elements 110, 112 disengage or by simply manually squeezing the spring elements 46' tightly against the longitudinal edges of the track member of replacement track 10C so that the locking elements 110, 112 separate.

It will be appreciated that the replacement track 10C is very similar to the basic replacement track 10 and requires only a slight modification in one pair of the spring fingers 46. Of course, use of replacement 10C presupposes that there are appropriate display racks 20C— that is, display racks having a locking element 112 in or on the sidewalls 24C thereof awaiting replacement tracks.

To summarize, the present invention also provides replacement tracks for display racks which are devoid of any upwardly projecting front lip. The replacement tracks useful in the "specially designed" embodiments of the present invention employ either removable front longitudinal segments or removable back longitudinal segments for adjustment of the length of the replacement track. Where the replacement track 10A or 10B has removable front longitudinal segments, the back of the track is provided with an abutment means adapted to abut against the back end of the channel, thereby to limit forward movement of the replacement track within the channel. Where the replacement track 10C has removable back longitudinal segments, one pair of spring fingers and the sidewalls of the channel are provided with cooperating locking elements to limit forward movement of the replacement track within the channel.

Now that the preferred embodiments of the present invention have been shown and described in detail, various modifications and improvements thereon will become readily apparent to those skilled in the art. Accordingly, the present invention is to be construed broadly and limited only by the appended claims, and not by the foregoing specification.

I claim:

1. A replacement track for a display rack channel devoid of any upstanding front lip, said replacement track comprising:

a generally planar, at least slightly flexible, longitudinally elongate track member defining a front portion, a back portion and a body portion connecting said front and back portions;

(i) said front portion defining a wedge-shaped front for lifting articles supported by an existing track of a channel above the existing track and onto said front portion as said front portion is moved between the articles and the existing track, said front portion defines a plurality of removable longitudinal segments with wedge-shaped fronts for enabling a reduction in the longitudinal length of said track member to fit in a channel, said front portion segments being successively removable for variably reducing the longitudinal length of said track member; and (ii) said body portion defining a top surface, a bottom surface and a pair of longitudinal edges connecting said top and bottom surfaces, said body portion having biasing means on each longitudinal edge thereof for centering and maintaining said track member in a channel, said biasing means being outwardly biased spring fingers extending outwardly from said longitudinal edges of said body portion a variable distance so that said replacement track fits a variety of channels of different widths.

2. The replacement track of claim 1 wherein each of said wedge-shaped fronts is generally convexly shaped.

3. The replacement track of claim 1 wherein at least said body portion defines on both said top and bottom surfaces thereof slide means for reducing the friction generated by an article sliding thereover, whereby said replacement track may be used in a regular or inverted orientation in the channel.

4. The replacement track of claim 3 wherein said slide means are a plurality of parallel, longitudinally extending ridges.

5. The replacement track of claim 3 wherein said front and back portions of said track member also define said slide means on the top and bottom surfaces thereof.

6. A replacement track for a display rack channel devoid of any upstanding front lip, said replacement track comprising:

a generally planar, at least slightly flexible, longitudinally elongate track member defining a front portion, a back portion and a body portion connecting said front and back portions;

(i) said front portion defining a wedge-shaped front for lifting articles supported by an existing track of a channel above the existing track and onto said front portion as said front portion is moved between the articles and the existing track, said front portion defines a plurality of removable longitudinal segments with wedge-shaped fronts for enabling a reduction in the longitudinal length of said track member to fit in a channel, said front portion segments being successively removable for variably reducing the longitudinal length of said track member and (ii) said body portion defining a top surface, a bottom surface and a pair of longitudinal edges connecting said top and bottom surfaces, said body portion having biasing means on each longitudinal edge thereof for centering and maintaining said track member in a channel, said biasing means being outwardly biased spring fingers extending outwardly from said longitudinal edges of said body portion a variable distance so that said replacement track fits a variety of channels of different widths;

said back portion of said track member having a back end enlarged in width relative to a back end of the channel to limit by abutment therewith the forward movement of said replacement track in the channel.

7. The replacement track of claim 6 wherein said track back end abuts both sides of the channel back end.

8. A replacement track for a display rack channel devoid of any upstanding front lip, said replacement track comprising:

a generally planar, at least slightly flexible, longitudinally elongate track member defining a front portion, a back portion and a body portion connecting said front and back portions;

(i) said front portion defining a wedge-shaped front for lifting articles supported by an existing track of a channel above the existing track and onto said front portion as said front portion is moved between the articles and the existing track, said front portion defines a plurality of removable longitudinal segments with wedge-shaped fronts for enabling a reduction in the longitudinal length of said track member to fit in a channel, said front portion segments being successively removable for variably reducing the longitudinal length of said track member; and (ii) said body portion defining a top surface, a bottom surface and a pair of longitudinal edges connecting said top and bottom surfaces, said body portion having biasing means on each longitudinal edge thereof for centering and maintaining said track member in a channel, said biasing means being outwardly biased spring fingers extending outwardly from said longitudinal edges of said body portion a variable distance so that said replacement track fits a variety of channels of different widths;

said back portion of said track member having a back end enlarged in height relative to a back end of the channel to limit by abutment therewith the forward movement of said replacement track in the channel.

9. The replacement track of claim 8 wherein said track back end defines a depending lug.

10. The replacement track of claim 9 wherein said track back end also defines an upstanding lug for use as the "depending" lug when said track replacement is used in an inverted orientation.

11. A display rack comprising:

(A) a channel having a transversely spaced pair of upstanding, longitudinally elongate sidewalls and a transversely extending, longitudinally elongate track joining said sidewalls, said channel having a back end and being devoid of any upstanding front lip; and (B) the replacement track of claim 1 intermediate said sidewalls and supported by said elongate track.

12. A replacement track for a display rack channel devoid of any upstanding front lip, said replacement track comprising:

a generally planar, at least slightly flexible, longitudinally elongate track member defining a front portion, a back portion and a body portion connecting said front and back portions;

(i) said front portion defining a wedge-shaped front for lifting articles supported by an existing track of a channel above the existing track and onto said front portion as said front portion is moved between the articles and the existing track, (ii) said back portion defining a plurality of removable longitudinal segments for enabling a reduction in the longitudinal length of said track member to fit in a channel, said back portion segments being successively removable for variably reducing the longitudinal length of said track member; and (iii) said body portion defining a top surface, a bottom surface and a pair of longitudinal edges connecting said top and bottom surfaces, said body portion having biasing means on each longitudinal edge thereof for centering and maintaining said track member in a channel, said biasing means including a plurality of longitudinally spaced pairs of outwardly biased spring fingers extending outwardly from said longitudinal edges of said body portion a variable distance so that said replacement track fits a variety of channels of different widths, one and only one of said pairs of spring fingers includes outwardly projecting engaging means for engaging with a cooperating inwardly projecting engaging means of the channel sidewalls to limit the forward movement of said replacement track in the channel when the engaging means interengage.

13. The replacement track of claim 12 wherein said wedge-shaped front is generally convexly shaped.

14. The replacement track of claim 12 wherein at least said body portion defines on both said top and bottom surfaces thereof slide means for reducing the friction generated by an article sliding thereover, whereby said replacement track may be used in a regular or inverted orientation in the channel.

15. The replacement track of claim 14 wherein said slide means are a plurality of parallel, longitudinally extending ridges.

16. The replacement track of claim 14 wherein said front and back portions of said track member also define said slide means on the top and bottom surfaces thereof.

17. A display rack comprising:

(A) a channel having a transversely spaced pair of upstanding, longitudinally elongate sidewalls and a transversely extending, longitudinally elongate track joining said sidewalls, said channel being devoid of any upstanding front lip and having an inwardly projecting engaging means on each of said sidewalls for cooperating with said outwardly projecting engaging means of said spring fingers to limit the forward movement of said replacement track in said channel; and (B) the replacement track of claim 12 intermediate said sidewalls and supported by said elongate track.

18. A display rack comprising:

(A) a channel having a transversely spaced pair of upstanding, longitudinally elongate sidewalls and a transversely extending, longitudinally elongate track joining said sidewalls, said channel having a back end and being devoid of any upstanding front lip; and (B) the replacement track of claim 6 intermediate said sidewalls and supported by said elongate track.

19. A display rack comprising:

(A) a channel having a transversely spaced pair of upstanding, longitudinally elongate sidewalls and a transversely extending, longitudinally elongate track joining said sidewalls, said channel having a back end and being devoid of any upstanding front lip; and (B) the replacement track of claim 8 intermediate said sidewalls and supported by said elongate track.

20. The display rack of claim 18 wherein said track back end abuts both sides of said channel back end.

21. The display rack of claim 19 wherein said track back end defines a depending lug.

22. The display rack of claim 15 wherein said track back end also defines an upstanding lug for use as the "depending" lug when said track replacement is used in an inverted orientation.

* * * * *